United States Patent [19]

Werne

[11] 4,329,137

[45] May 11, 1982

[54] DEVICE FOR CHOKE ADJUSTMENT

[76] Inventor: Stig Werne, 13, Hermelinsvägen, S-433 00 Partille, Sweden

[21] Appl. No.: 145,420

[22] Filed: May 1, 1980

[30] Foreign Application Priority Data

May 2, 1979 [SE] Sweden ..... 7903808

[51] Int. Cl.[3] ..... F23N 5/00

[52] U.S. Cl. ..... 431/75; 236/15 BD; 431/90

[58] Field of Search ..... 431/12, 90, 75, 76; 236/15 BD, 15 E

[56] References Cited

U.S. PATENT DOCUMENTS

| | | | |
|---|---|---|---|
| 2,397,987 | 4/1976 | Senhinger | 431/90 X |
| 3,236,449 | 2/1966 | Brunner | 431/90 X |
| 3,814,570 | 6/1974 | Guigues | 431/76 |
| 4,008,039 | 2/1977 | Compton et al. | 431/90 |
| 4,227,872 | 10/1980 | Zink et al. | 431/90 |
| 4,249,886 | 2/1981 | Bush | 431/90 |

*Primary Examiner*—Edward G. Favors
*Attorney, Agent, or Firm*—Sughrue, Mion, Zinn, Macpeak and Seas

[57] ABSTRACT

The invention has for its object to provide a control unit for the air choke in an oil burning installation which affords good fuel economy and is simple in construction, while being at the same time easy to mount and adjust. The control unit is composed of a piston cylinder (14) the pressure side of which is connected to the pressure side of the fuel pump (22) of the plant in such a manner that its piston (24) performs a working stroke when the pump starts and returns to the starting position when the pump stops. The piston rod (18) of the piston cylinder unit is coupled to a throttle which opens as a result of said working stroke and closes on the return movement. The piston cylinder unit is provided with a mobile end position abutment which consists of a secondary piston (29) which is slidably mounted in a secondary cylinder housing (30) which communicates with a sensing device (33) disposed in or adjacent the flue gas duct of the burning plant, which sensing device encloses an expansion liquid, the degree of expansion of which depending upon temperature determines the displacement position of the secondary piston and thus of the end position abutment, and also the reduction of the degree of opening of the throttle on increased flue gas temperature, and vice-versa.

3 Claims, 3 Drawing Figures

16
15
14
23
0 5 10 15
21
22
17
18
19
20
11
12
13
10
6
7
8
5
9
4
3
2
1
1'
2'

DEVICE FOR CHOKE ADJUSTMENT

The present invention relates to an arrangement for a choke adjustment depending upon working conditions in oil burning plant.

The principal object of the invention is to provide an automatically-operating choke adjustment which affords the oil burning plant satisfactory operational economy and which is simple to mount on both new and existing oil burning plant.

The device according to the invention is characterised in that it is composed of an operating unit consisting in a piston cylinder the pressure side of which is connected to the pressure side of the fuel pump of the plant in such a manner that the piston performs a working stroke when the pump starts and returns to the starting position when the pump stops, the piston rod of the piston cylinder unit being coupled to a throttle which opens as a result of said working stroke and closes on the return stroke, the piston cylinder unit being provided with a mobile end position abutment consisting in a secondary piston which is slidably mounted in a secondary cylinder housing which communicates with a sensing device which encloses an expansion fluid the volume of which being determined by the temperature of the flue gases from the oil burning plant and the degree of expansion of said liquid determines the displacement position of the secondary piston and thus of the end position abutment, and also the reduction of the degree of opening of the throttle on increased flue gas temperature, and vice-versa.

Figure 1:
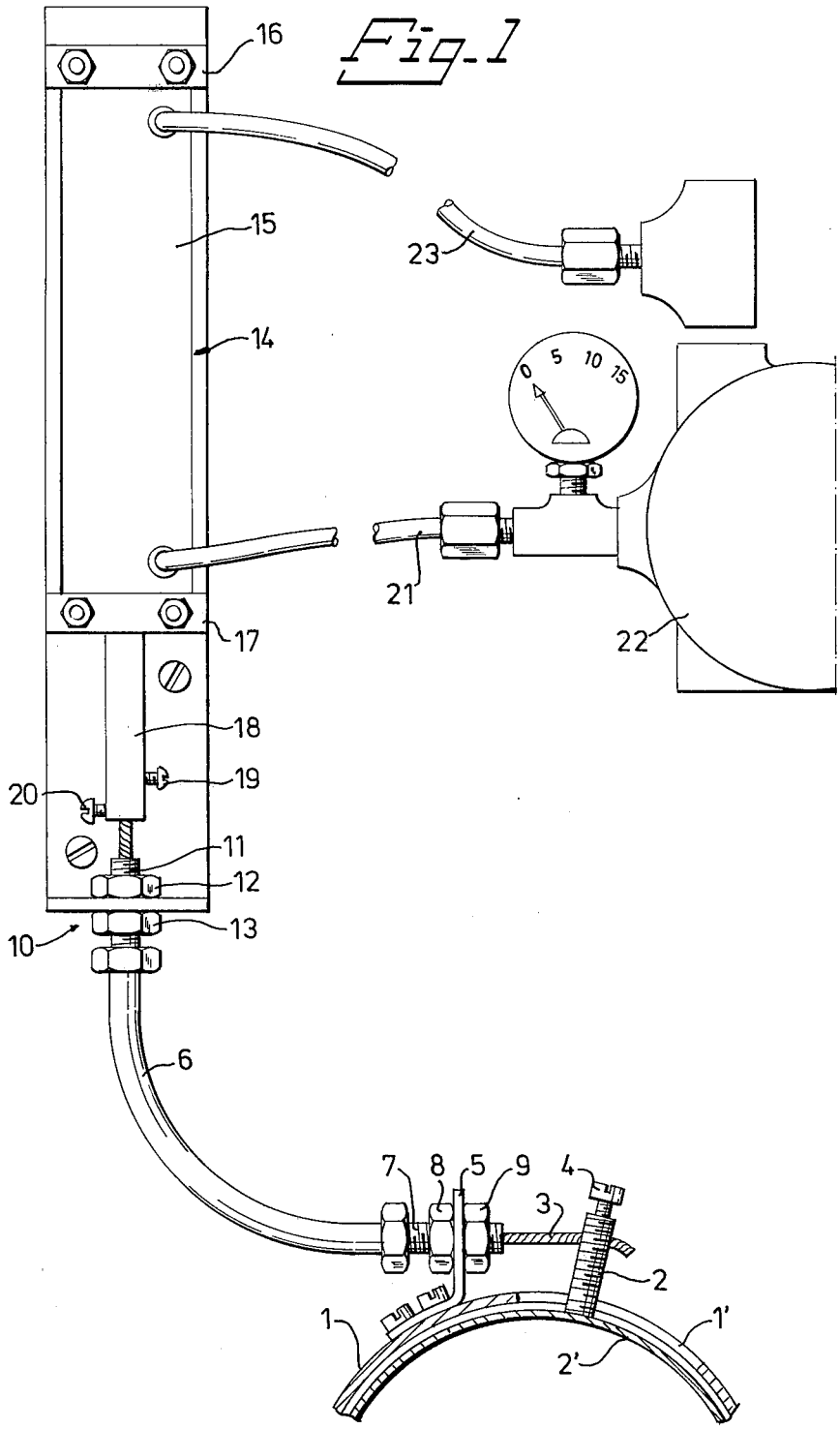
Figure 2:
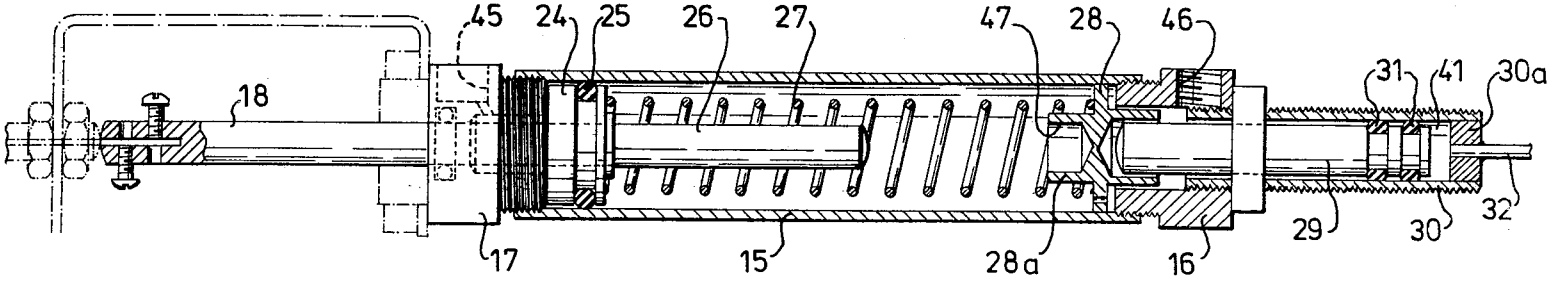
Figure 3:
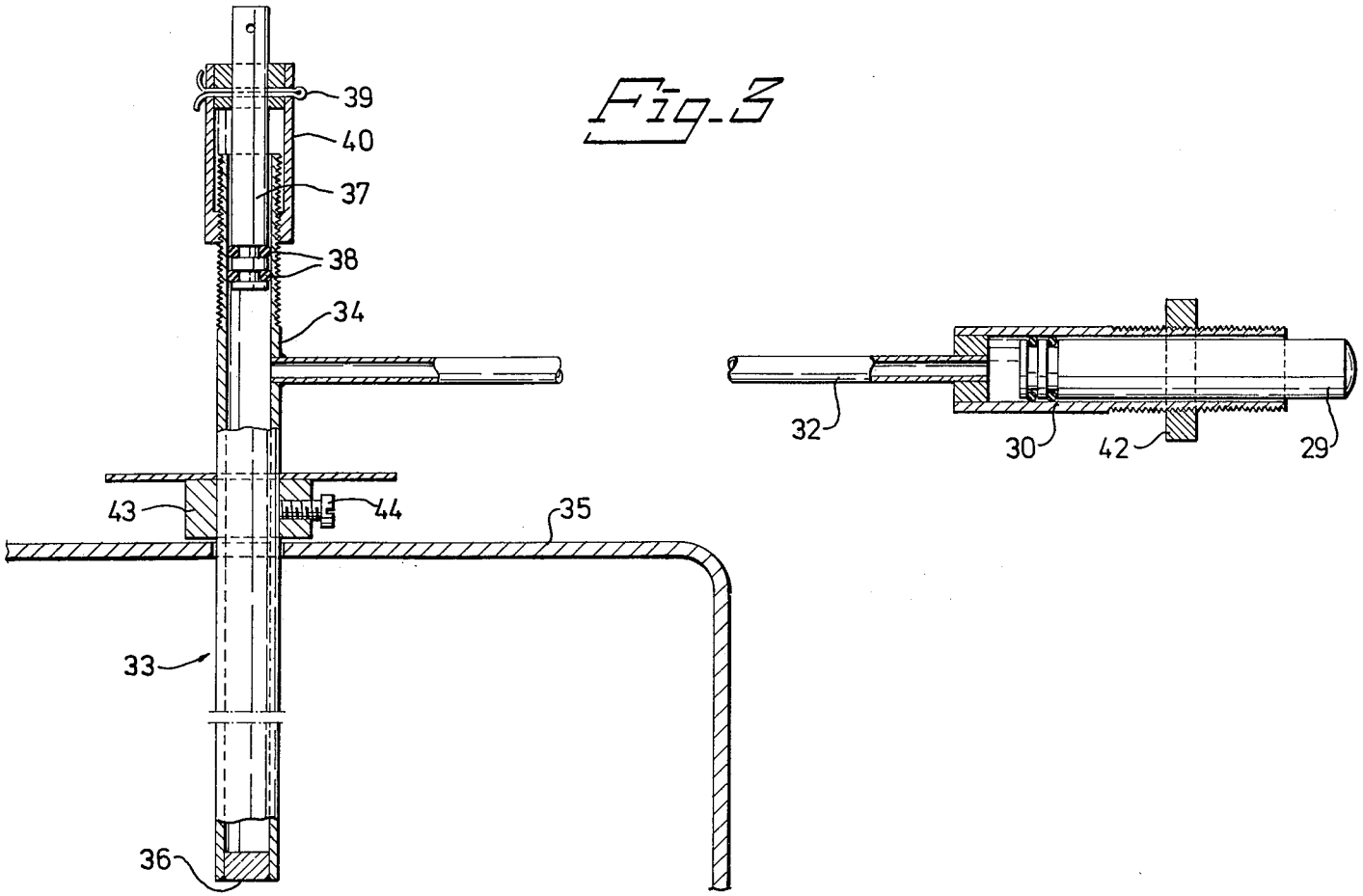

Hereinbelow an example of embodiment of the subject of the invention is described with reference to the attached drawings in which FIG. 1 represents diagrammatically a choke adjustment entering an oil burning plant for the opening and closing of an air throttle depending upon the working conditions in the fuel pump of an oil burning installation;

FIG. 2 is a modified construction of a part entering in a control unit according to FIG. 1, and FIG. 3 shows another detail of this modified embodiment.

In FIG. 1 reference 1 denotes a housing for the air supply to the firing area in a burning installation. The opening position of the throttle is regulated by means of the adjustment of the position in a wire holder 2 in which an operating wire 3 is secured by means of a clamping screw 4. The wire holder 2 is fixed to a tube shaped throttle 2′ in the embodiment shown. The housing 1 is provided with a slot 1′ in which the holder 2 is slidable such that the throttle 2 is rotated around its axis. The throttle 2 is provided with an opening, not shown, which cooperates with the outlet opening of an air fan, not shown. The relative positions of said openings determine the through-flow area between the fan and the firing area. It is obvious that other types of throttle devices may be used without departing from the invention. Furthermore, on the throttle housing 1 a holder 5 is disposed for a wire casing 6 which is held at the holder 5 by means of a threaded end element 7 and locknuts 8,9 screwed on the latter. The other end of the wire casing 6 is coupled to a further holder 10 by means of another threaded end element 11 and nuts 12,13 screwed on the latter. The holder 10 supports furthermore a piston cylinder unit 14 which consists in a cylindrical housing 15 and side elements 16,17 closing its ends. Out of one side of the housing a piston rod 18 projects which has an axial perforation in which one end of the wire 3 is introduced and fastened by means of clamping screws 19,20. One end of the piston cylinder is connected by means of a lead 21 to the pressure side of the burning installation pump unit 22, and its other end is connected by means of a lead 23 to the low pressure side of the pump unit. In the cylinder 15 a piston 24 is slidably mounted which is made tight against the cylinder wall by means of an O-ring 25 set in a groove. In one direction the piston rod 18 projects through the side element 17 and in the other direction a stop bar 26 projects from the piston. The stop bar 26 is encompassed by a pressure spring 27 which rests at one end against the piston and at the other end rests against the side element 16 through a pressure washer 28 which has a projecting portion 28*a* around which the pressure spring is centered. Furthermore, the projecting portion 28*a* of the pressure washer has a central perforation 47 at its abutment against the pressure washer. The side element 16 has a central perforation through it, in which a secondary piston 29 slides, the latter being slidably mounted in a secondary cylinder housing 30 screwed together with the side element 16. The secondary piston 29 is tightened against the cylinder housing 30 by means of O-rings 31. Into the side 30*a* of the cylinder housing 30 there opens out a communication lead 32, the other end of which is connected to a sensing element head 33 which consists in a tube 34 one end portion of which is inserted in the flue gas duct 35 of the oil burning plant or positioned within an area adjacent the duct 35, said area having a temperature depending on the temperature of the flue gases. The end portion of the tube 34 entering the flue gas duct is closed by means of an end closure 36, and its other end is closed by means of an adjustable piston 37 which is tightened against the inside of the tube by means of O-ring seals 38. The end portion of the piston 37 projecting from the tube 34 is held by means of a transversal split pin 39 against a casing 40 which is provided with an internal thread which engages in an external thread on the tube. By rotating the casing 40 the projecting position of the piston 37 can thus be adjusted. The sensing element head 33, the communication duct 32 and the space 41 formed between the side element 30*a* and the secondary piston 29 receive a liquid the degree of expansion of which depending upon the temperature of the flue gases determines the projecting position of the secondary piston 29 and thereby the position in which the piston 24 abuts against the abutment washer 28. The fine adjustment of this position may be effected by the setting of the setting piston 37. Naturally, it is also possible to carry out this adjustment by screwing the secondary piston cylinder 30 in the side element 16 and securing by means of a lock nut 42. The sensing element head 33 is secured on the flue gas duct by means of a lock ring 43 and a tensioning screw 44 mounted in it. The pressure duct 21 from the fuel pump is connected to a perforation 45 in the side element 17 and the return duct 23 is connected to a perforation 46 in the side element 16. The perforation 45 is in communication with the space situated to the left of the piston 24 according to FIG. 2 and the perforation 46 communicates with the space which is situated to the right of the piston according to FIG. 2. The spring 27 strives constantly to bring the piston 24 leftwards according to FIG. 2 and therefore close the air throttle situated in the throttle housing 1. When the fuel pump 22 starts, the excess pressure in the duct 21 rises which, against the action of the spring 27 slides the piston 24 to the right according to FIG. 2 and thereby opens the air throttle 2' till the pressure bar 26 strikes against the abutment washer 28. As the temperature rises in the flue gases passing through the flue gas duct 35, the liquid contained in the sensing element 33, the communication duct 32 and the cylinder space 41 expands and slides the secondary piston to the left according to FIG. 2, as a consequence of which also the abutment washer 28 slides to the left. As a result of this there takes place a reduction of the degree of opening of the throttle which contributes towards a good fuel economy in the installation. When the piston 24 moves to the right according to FIG. 2 the liquid on the right of the piston flows past or through openings in the washer 28 and through the duct 23. When the installation stops and the pressure ceases in the duct 21 the pressure spring 27 returns the piston to its position shown in FIG. 2.

The magnitude of the movement of the secondary piston 29 on the alteration of the temperature in the flue gases may be varied by means of the modification of the insertion position of the sensing element in the flue gas tube, i.e. the stroke increases when the sensing element is inserted to a considerable extent and reduces when the sensing element is brought out. By means of 38 there is denoted a cooling flange disposed outside the flue pipe.

The invention is not restricted to the embodiment described above and shown on the drawings solely for the sake of example, which can vary in its details for the following claims without departing from the basic idea of the invention.

I claim:

1. An arrangement for choke adjustment depending upon the working conditions in oil burning plant, characterised in that it is composed of an operating unit (14) consisting in a piston cylinder (15) the pressure side of which is connected to the pressure side of the fuel pump (22) of the plant, in such a manner that the piston (24) performs a working stroke when the pump starts and returns to the starting position when the pump stops, the piston rod (18) of the piston cylinder unit being coupled to a throttle which opens as a result of said working stroke and closes on the return stroke, the piston cylinder unit being provided with a mobile end position abutment consisting in a secondary piston (29) which is slidably mounted in a secondary cylinder housing (30) which communicates with a sensing device (33) which encloses an expansion liquid the volume of which being determined by the temperature of the flue gases from the oil burning plant and the degree of expansion of said liquid determines the displacement position of the secondary piston and thus the end position abutment, and also the reduction of the degree of opening of the throttle on increased flue gas temperature, and vice-versa.

2. An arrangement according to claim 1, characterised in that the sensing device (33) is made up of a tube (34) closed at both its ends, insertable into the flue gas duct, in the end of which situated outside the flue gas duct an adjusting piston (37) is axially slidably mounted, and through the displacement of which the position of the end position abutment can be adjusted.

3. An arrangement according to claim 1 or 2, characterised in that the secondary piston (29) is passed through one side (16) of the control unit.

* * * * *